US005215218A

United States Patent [19]

Choi

[11] Patent Number: 5,215,218

[45] Date of Patent: Jun. 1, 1993

[54] ELECTRIC TOOTHPASTE DISPENSER

[76] Inventor: Min K. Choi, 21710 Park Valley, Katy, Tex. 77450

[21] Appl. No.: 698,714

[22] Filed: Sep. 5, 1991

Related U.S. Application Data

[63] Continuation-in-part of Ser. No. 478,412, Feb. 12, 1990, Pat. No. 5,050,773, and Ser. No. 7,161, Dec. 6, 1990.

[30] Foreign Application Priority Data

| | | | |
|---|---|---|---|
| Dec. 6, 1989 | [KR] | Rep. of Korea | 18497 |
| Apr. 19, 1990 | [KR] | Rep. of Korea | 4830 |
| Apr. 13, 1991 | [KR] | Rep. of Korea | 5115 |
| Apr. 24, 1991 | [KR] | Rep. of Korea | 5684 |

[51] Int. Cl.[5] ..... B65D 35/28

[52] U.S. Cl. ..... 222/63; 222/96; 222/102; 222/181; 222/509; 141/355; 141/362

[58] Field of Search ..... 222/52, 63, 333, 94, 222/101, 102, 105, 181, 185, 325, 96, 505, 509, 639, 642; 141/360, 362, 355, 352

[56] References Cited

U.S. PATENT DOCUMENTS

| | | | |
|---|---|---|---|
| 1,845,291 | 2/1932 | Koontz | 222/102 |
| 2,528,662 | 11/1950 | Miller | 222/101 |
| 2,563,733 | 8/1951 | Meczelski | 222/93 |
| 2,596,683 | 5/1952 | Hawkins | 222/101 |
| 3,198,389 | 8/1965 | Dunning | 222/93 |
| 3,313,454 | 4/1967 | Welsh et al. | 222/102 |
| 3,581,943 | 6/1971 | Koenigshof | 222/102 |
| 3,860,147 | 1/1975 | Vessio et al. | 222/102 X |
| 4,234,104 | 11/1980 | Apuzzo, Jr. et al. | 222/94 |
| 4,258,864 | 3/1981 | Karamanolis et al. | 222/101 X |
| 4,403,714 | 9/1983 | Kane | 222/101 |
| 4,421,252 | 12/1983 | Ylitalo | 222/102 |
| 4,508,242 | 4/1985 | Wolfe | 222/102 |
| 4,629,095 | 12/1986 | Smith | 222/102 X |
| 4,921,150 | 5/1990 | Lagergren et al. | 222/639 |
| 4,938,384 | 7/1990 | Pilolla et al. | 222/639 X |

FOREIGN PATENT DOCUMENTS

| | | | |
|---|---|---|---|
| 2345650 | 3/1975 | Fed. Rep. of Germany | 222/185 |
| 2639991 | 3/1978 | Fed. Rep. of Germany . | |
| 2644151 | 4/1978 | Fed. Rep. of Germany | 222/642 |
| 3904143 | 8/1990 | Fed. Rep. of Germany | 222/102 |
| 2443975 | 7/1980 | France . | |

*Primary Examiner*—Andres Kashnikow
*Assistant Examiner*—A. Pomrening
*Attorney, Agent, or Firm*—Mark A. Oathout

[57] ABSTRACT

The present invention relates to an improved toothpaste dispensing apparatus which includes a housing having a grasping assembly for holding the toothpaste container, a guide and brace assembly for supporting the toothpaste container and a nozzle assembly including a capping mechanism for dispensing the toothpaste. A drive assembly is mounted within the housing and drives a carriage assembly for squeezing the toothpaste container. A control system is also included for activating the drive assembly and for automatic reversal of the drive assembly.

14 Claims, 13 Drawing Sheets

ELECTRIC TOOTHPASTE DISPENSER

This is a continuation-in-part of application Ser. No. 07/478,412 filed on Feb. 12, 1990, now U.S. Pat. No. 5,050,773 and Application No. U.S. Ser. No. 90/07161 filed on Dec. 6, 1990, still pending.

FIELD OF THE INVENTION

The present invention generally relates to an electric toothpaste dispenser and, more particularly, is concerned with a toothpaste dispenser which is operated by depressing a button with a toothbrush. When the dispenser is empty a user merely replaces the toothpaste container.

DESCRIPTION OF THE PRIOR ART

The typical toothpaste tube in use today has been in use for many years after gaining wide acceptance. This typical toothpaste tube is relatively easy to use although it has a few shortcomings. Some of the shortcomings include leakage from the tube due to cracks and tears forming in the walls of the tube, leakage between the mouth and the cap of the tube due to the combination of failing to properly tighten the cap onto the tube and the placement of improper pressure upon the tube, wasted toothpaste remaining in the tube due to uneven squeezing or rolling of the tube, the inconvenience of unscrewing and replacing a cap every time toothpaste is to be used and problems related to the application of too much pressure to the tube resulting in additional wasted toothpaste and toothpaste spillage onto the counter and sink. All of these problems are compounded when the toothpaste tube is used by children.

There are also certain individuals who gain satisfaction through the use of electric gadgets in the home. Such individuals may find the installation of an electrically driven toothpaste dispenser to be pleasing.

Several toothpaste dispensing apparatii have been disclosed in the past. U.S Pat. No. 3,198,389 to Dunning discloses a toothpaste dispensing cabinet which uses two rollers to roll down a tube of toothpaste. U.S. Pat. No. 4,234,104 to Apuzzo et al describes a toothpaste dispenser having a motor for driving two rollers down a tube of toothpaste. The outlet from the dispenser includes a closure and a manually operated switch is included to reverse the motor. U.S. Pat. No. 4,258,864 to Karamanolis et al describes a toothpaste dispenser with a motor which drives a roller down a tube of toothpaste. A manually operated switch is used to retract the roller and a gate is used to close off the outlet. U.S. Pat. No. 4,403,714 to Kane describes a toothpaste dispenser with a motor driven roller which compresses paste out of a horizontally mounted tube of paste. The tube is threaded into an adapter and the outlet is covered by a lever 21. The motor is reversed by a manual switch. U.S. Pat. No. 4,629,095 to Smith describes a toothpaste dispenser which is carried by a wheel for driving the tube through a pair of pinch rollers. The tube of paste is inverted and threaded into an aperture which is closed off by a flap closer.

The patents described above have several shortcomings. They fail to recognize the importance of having pliable rollers which will provide an evenly distributed squeeze across the tube. Resiliency in the rollers is desired to accommodate different sized tubes and obstructions in the tubes. While some of the patents do mention that the rollers may be spring mounted, they fail to recognize that spring created resiliency will result in an imbalanced or uneven squeeze across the tube. Another problem is that these patents fail to provide drive to the rollers. Only the patent to Dunning, U.S. Pat. No. 3,198,389, provides rotational drive to the rollers. However, the drive is provided by a pulley system which will be expensive to construct and will encounter problems due to slippage of the pulley.

These patents also have drawbacks relating to the guidance of the toothpaste tube between the rollers when the rollers begin at the bottom of the tube and when the tube is improperly aligned or oriented with respect to the rollers. These drawbacks are important since a dispenser must accommodate various sizes of toothpaste tubes as well as bent toothpaste tubes and adjust for improperly aligned toothpaste tubes. Additionally, these patents fail to address problems related to the rollers forcing the tube to collapse against the housing or the outlet or pulling the tube out of the outlet due to the reversal of the rollers or frictional forces from the rollers. These patents also require that a switch be manually activated, as opposed to automatically activated, to reverse a roller assembly which has completed its compressing motion across the toothpaste tube.

Other problems include the placement of the outlet at the bottom of the housing. This requires that the toothpaste tube be placed in an inverted position which in turn requires that a closure device be placed at the outlet to prevent toothpaste from seeping out of the dispenser due to gravity. Additionally, no device is described for adapting to, connecting to and holding the tube within the housing. Since toothpaste tubes are made of various sizes and designs it is important to include adjustable or adaptable structures to hold the tube and to connect to the mouth of the tube. The patents described above further fail to recognize the importance of making the outlet nozzle removable so that clogged toothpaste can be removed.

Further shortcomings include the failure to recognize other features which can be added for ease of operation of the dispenser including the addition of an easily accessible button which will activate the dispenser by pressing down with the back side of a toothbrush. The patents above which use a toothbrush activated lever will result in toothpaste being rubbed on or transferred to the surrounding housing and accessory structure. The dispenser can also be made more convenient by including a wall mount and a toothbrush holder which is mounted on the outside for accessibility while being removable for ease of cleaning. Additionally, these patents use alternating current to power the motor which increases the risk of electrocution.

The need therefore exists for an electric toothpaste dispenser which is easily mountable and accessible for holding toothbrushes while allowing for cleaning, which prevents the likelihood of electrocution through the use of a d/c converter, which will provide proper and efficient drive to the rollers, which will provide an even and pliable squeeze to the tube of toothpaste, which will hold a tube of toothpaste in the upright position while being adaptable to accommodate various sizes and designs of toothpaste tubes and which will allow for ease of controlling the dispenser without a mess due to toothpaste being rubbed onto parts of the dispenser.

SUMMARY OF THE INVENTION

The present invention provides an electric toothpaste dispenser designed to satisfy the aforementioned needs. The present invention relates to an improved toothpaste dispensing apparatus which includes a housing having a grasping assembly for holding the toothpaste container, a guide and brace assembly for supporting the toothpaste container and a nozzle assembly including a capping mechanism for dispensing the toothpaste. A drive assembly is mounted within the housing and drives a carriage assembly for squeezing the toothpaste container. A control system is also included for activating the drive assembly and for automatic reversal of the drive assembly. The dispenser includes pliable rollers to apply a balanced and even squeeze across the toothpaste tube. When the rollers have reached the end of the tube, the control system will automatically reverse the motor so that the rollers roll back across the tube. If the outlet nozzle becomes clogged, it can be removed for soaking. The present invention includes additional important accessories including an easily accessible activation button, a wall mount, a removable toothbrush holder and a d/c converter.

DETAILED DESCRIPTION OF THE INVENTION

Figure 2:
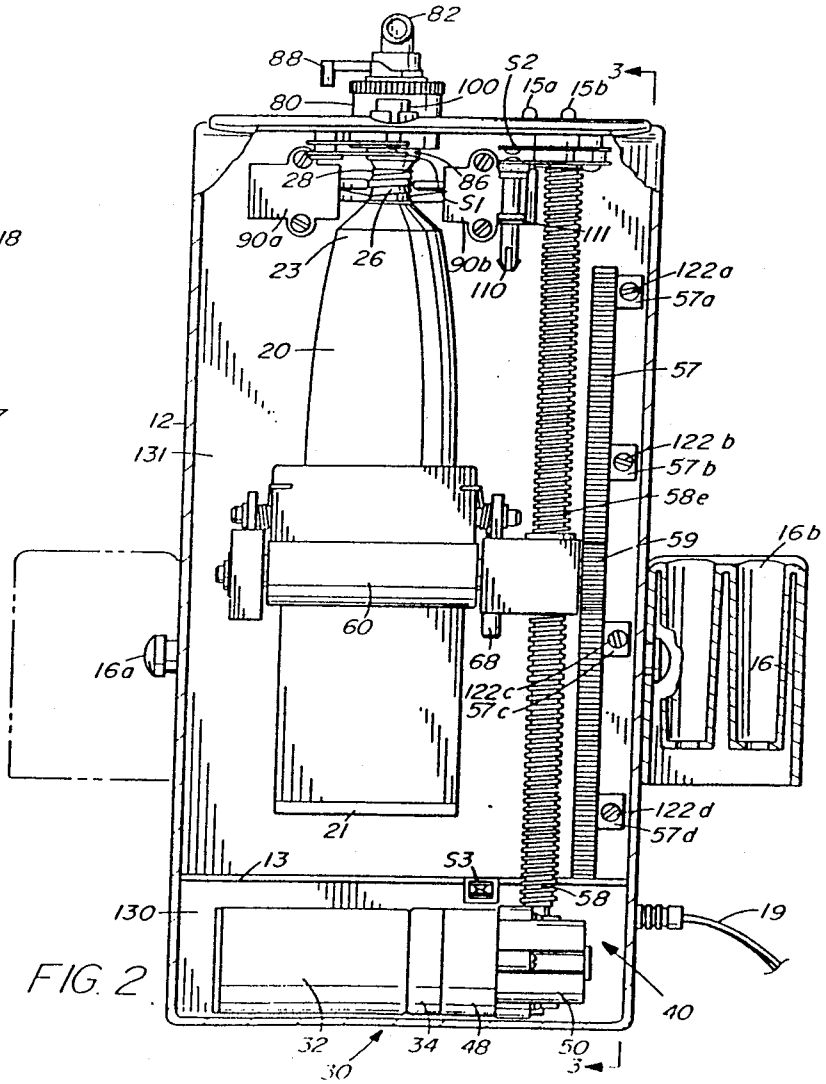
FIG. 2 is a front elevational view taken along section line 2—2 of FIG. 1 to show the interior of the housing.
Figure 1:
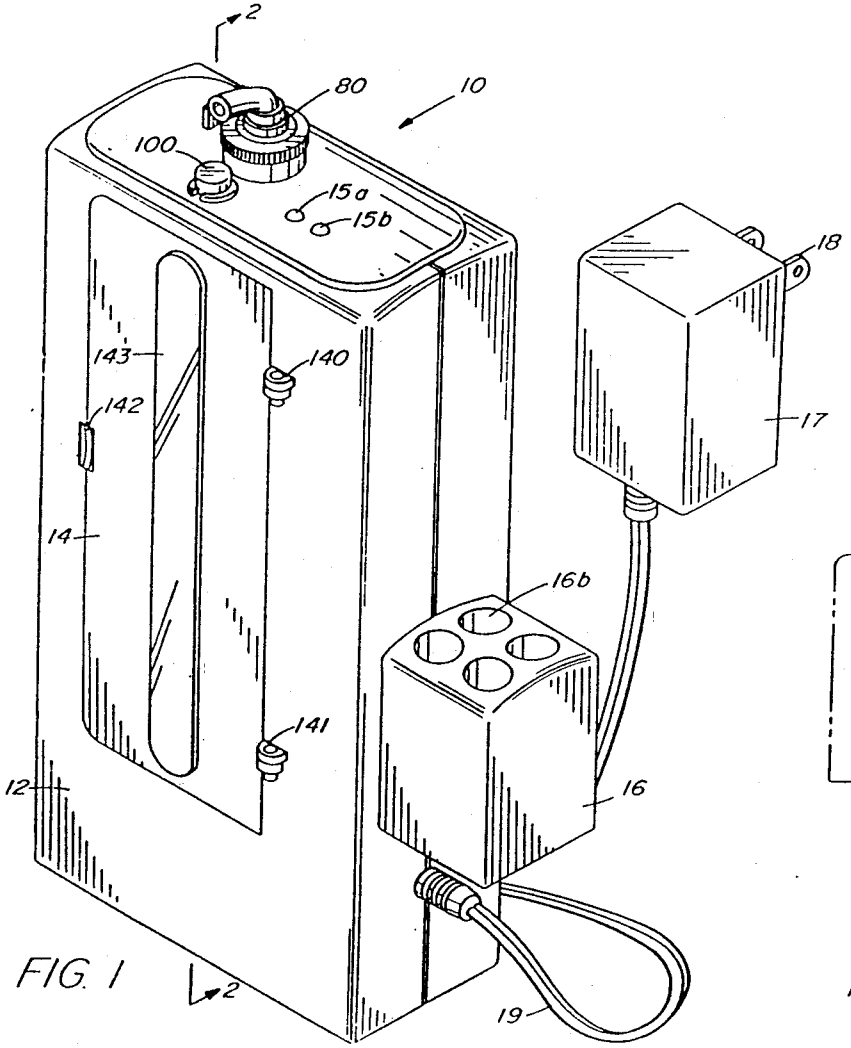
FIG. 1 is a perspective view of the toothpaste dispenser.

Referring now to the drawings, and more particularly to FIG. 1, there is shown the electric toothpaste dispenser apparatus 10. Referring now to FIG. 2, the electric toothpaste dispenser 10 generally includes a housing 12, a toothpaste container 20, a drive assembly 30, a carriage assembly 60, a nozzle assembly 80 and first and second grasping assemblies **90*a* and 90*b***.

Referring back to FIG. 1, the dispenser 10 includes a housing 12 with a door 14. The dispenser 10 also includes a toothbrush holder 16, a d/c converter 17 with a/c wall socket plug-in prongs 18 and electrical cord 19, a nozzle assembly 80 and a push button 100. Access to the interior region of the housing 12 is made through the door 14 which is large enough to allow the convenient insertion by hand of a toothpaste container or tube 20. The door 14 has two hinges 140 and 141 and a latch 142 which snaps into a groove in the housing 12 for holding the door 14 in a closed position. The door 14 also includes a window 143 for viewing the toothpaste container 20 so that a user can determine the brand and amount of toothpaste which has been used. The electric toothpaste dispenser 10 is activated by depressing the push button 100 with a toothbrush 22 or other device. This causes toothpaste 24 to be dispensed out of the nozzle assembly 80. Lights **15*a* and 15*b* are located on the housing 12. Light 15*a* is preferably blue and turns on when toothpaste 24 is being dispensed through the nozzle assembly 80. Light 15*b* is preferably red and turns on when the toothpaste container 20** is empty.

Figure 3:
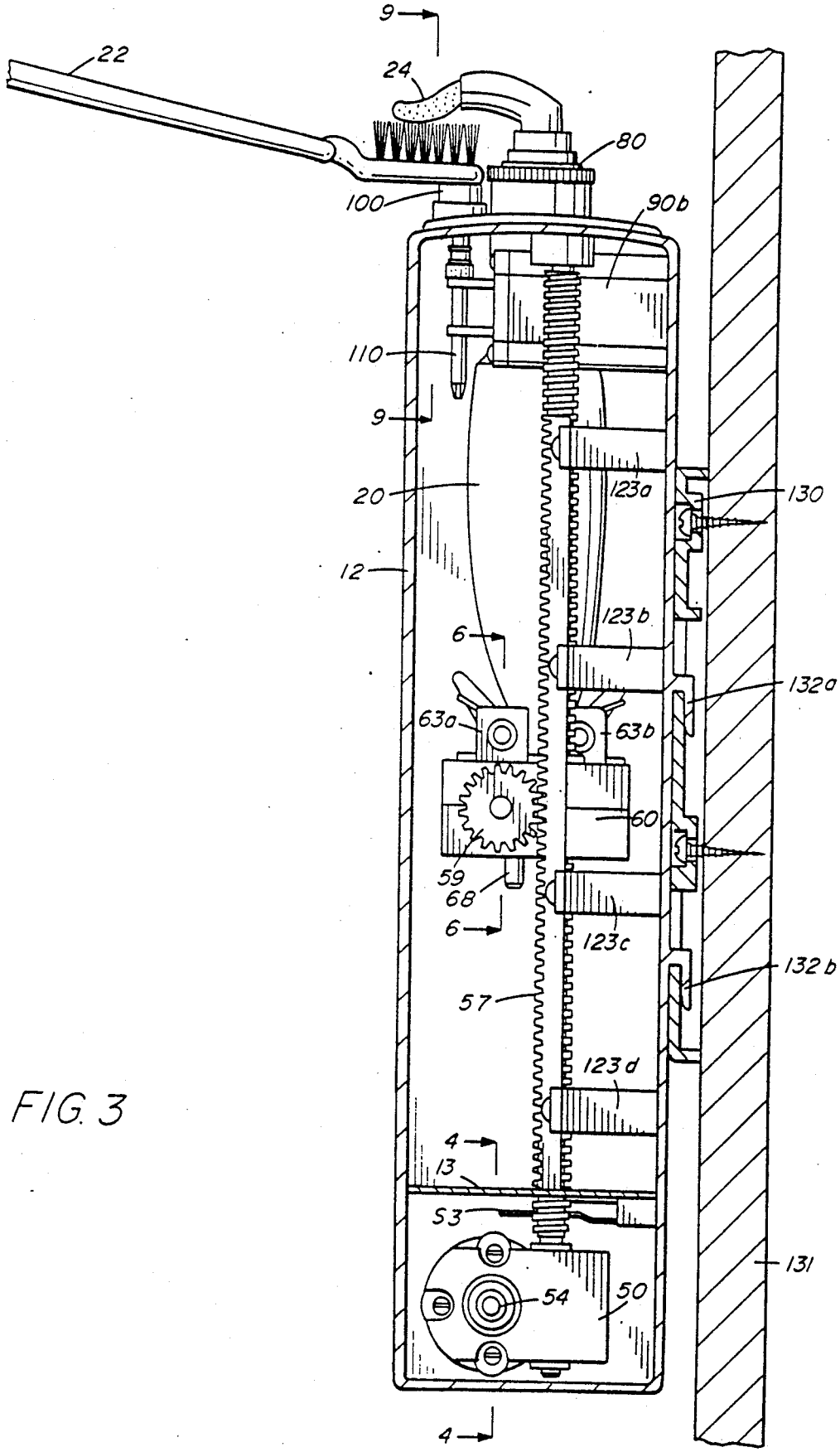
FIG. 3 is a side elevational view of the dispenser taken along section line 3—3 of FIG. 2.

Referring now to FIGS. 2 and 3, the interior of housing 12 is shown. A wall 13 separates a lower section 130 of the housing 12 from an upper section 131. Drive assembly 30 generally includes motor 32 and gear train 40. Gear train 40 transfers drive or torque to carriage assembly 60.

Current from the d/c converter 17 runs through the cord 19 into the lower section 130 for powering motor 32. When the push button 100 is depressed it will close the first switch S1 which turns on light **15*a* and activates the motor 32 in the forward or toothpaste dispensing direction. A frame 34 is attached to the end of the motor 32. The other end of the frame 34 is attached to a planetary gear 48 which is in turn attached to a gear box 50. The internal components of the gear box 50 transfer torque or drive to a long screw 58. When the long screw 58 is rotated it will transfer torque to or drive carriage assembly 60. More specifically, carriage assembly 60 will move along threads 58*e* causing pinion 59 to turn on rack 57 which is installed parallel to the long screw 58. The rack 57 is attached to the housing 12 with screws 122*a*, 122*b*, 122*c* and 122*d* which are threaded through rack mounting supports 57*a*, 57*b*, 57*c* and 57*d* and into casings 123*a*, 123*b*, 123*c* and 123*d* which are affixed to the housing 12. The pinion 59 transfer torque or drive to the carriage assembly 60. As the carriage assembly 60 rides up the length of the long screw 58 it will squeeze toothpaste out of the toothpaste container 20. When the carriage assembly 60 approaches the top of the toothpaste container 20 it will force toggle bar 110 to strike or close reverse switch or second switch S2. The reverse switch S2 will turn on light 15***a* and automatically activate the motor 32 in the reverse direction such that the carriage assembly 60 will ride downward until a prong 68 strikes or opens a third switch S3. In this position the carriage assembly 60 will rest below the lower end of the tube of toothpaste 20 so that the empty tube or container may be removed for disposal and a new container may be installed. The toothpaste container 20 is held around the neck 26 of the container 20 by a first and a second grasping assembly 90*a* and 90*b*.

The nozzle assembly 80 includes a lever 88 for the lowering of a tube fitting 86 into the mouth 28 of the toothpaste container 20. Once the tube fitting 86 is in place within or against the mouth 28 of the toothpaste container 20, toothpaste 24 can flow through the tube fitting 86 and out spout 82.

The toothbrush holder 16 could be mounted on either side of the housing 12 by any suitable means of attachment such as a hole and channel formed in the side of the toothbrush holder 16 for sliding over a projecting rivet head 16*a*. The toothbrush holder 16 has receptacles 16*b* for receiving toothbrush 22. Referring to FIG. 3, the electric toothpaste dispenser 10 also includes a wall mount plate 130 which may be screwed or attached by other suitable means of attachment to a wall 131 or other structure. The mounting plate 130 has openings which receive prongs 132*a*, 132*b*, 132*c* (not shown) and 132*d* (not shown) fixed on housing 12. The prongs 132*a*, 132*b*, 132*c* and 132*d* are slid into the openings on mounting plate 130 and the housing 12 is lowered until the prongs 132*a*, 132*b*, 132*c* and 132*d* grasp around and the housing 12 rests on the mounting plate 130. Housing 12 may include other accessories.

Figure 4:
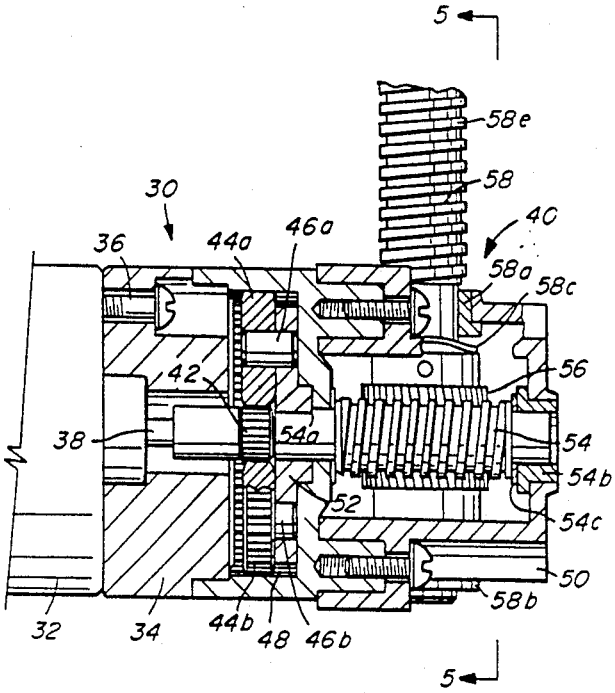
FIG. 4 is a detail view of the drive assembly taken along section line 4—4 of FIG. 3.
Figure 5:
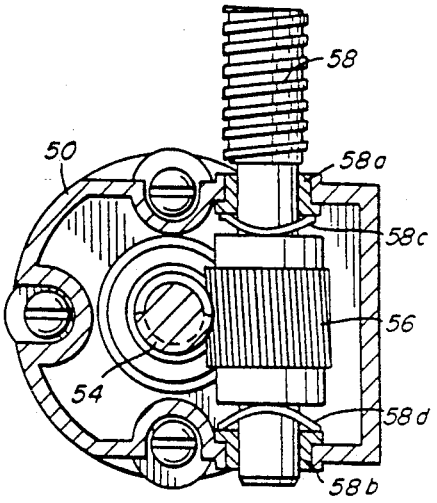
FIG. 5 is a detail view of the drive assembly taken along section line 5—5 of FIG. 4.

Referring to FIGS. 4 and 5, portions of the drive assembly 30 for driving carriage assembly 60 are shown. Frame 34 is attached by a screw 36 to the motor 32. The drive shaft 38 driven by the motor 32 transmits torque to gear train 40 through a pinion gear 42 located at the other end of the drive shaft 38. Gear train 40 ends with long screw 58.

The pinion gear 42 meshes with three idle gears 44*a*, 44*b* and 44*c* (not shown) which are equiangularly arranged around the pinion gear 42. Opposite the point of contact between the idle gears 44*a*, 44*b* and 44*c* and the pinion gear 42, the idle gears 44*a*, 44*b* and 44*c* mesh with a planetary gear 48. The planetary gear 48 remains stationary. The idle gears 44*a*, 44*b* and 44*c* are pinned to a revolution disc 52. As the pinion gear 42 drives the three idle gears 44*a*, 44*b* and 44*c* the idle gears 44*a*, 44*b* and 44*c* will rotate about their central axis on shafts 46*a*, 46*b* and 46*c* (not shown) as well as orbit within the planetary gear 48. Revolution disc 52 is seated within but does not mesh with the planetary gear 48. Hence, the orbital motion of the idle gears 44*a*, 44*b* and 44*c* will cause the revolution disc 52 to turn. The revolution disc 52 has a keyed opening in the center for engaging a notch 54*a* in worm gear 54. The worm gear 54 is supported at the other end by a worm bush 54*b*. The worm gear 54 transmits torque to a worm wheel 56. Worm wheel 56 is pinned or attached by other suitable means over the end of the long screw 58. A gear box 50 is attached to the planetary gear 48 for enclosing the worm gear 54 and the worm wheel 56 and holding the worm bush 54*b* in place. A washer 54*c* is placed between the worm bush 54*b* and the worm gear 54. The gear box 50 also contains two long screw bushes 58*a* and 58*b* for support of long screw 58. Wave washers 58*c* and 58*d* are placed between the long screw bushes 58*a* and 58*b* and the worm wheel 56.

Figure 7:
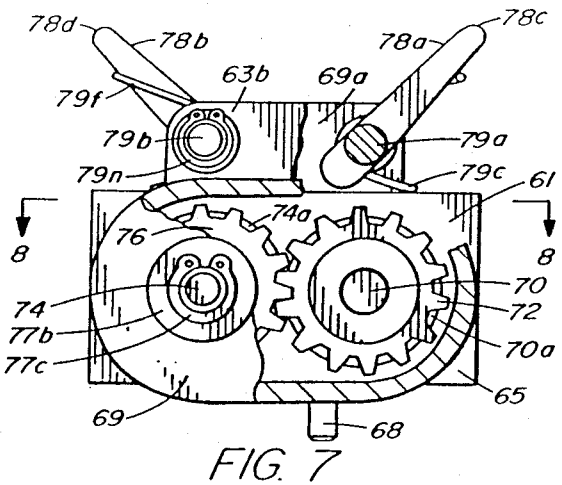
FIG. 7 is a detail view partially broken along section line 7—7 of FIG. 6.
Figure 6:
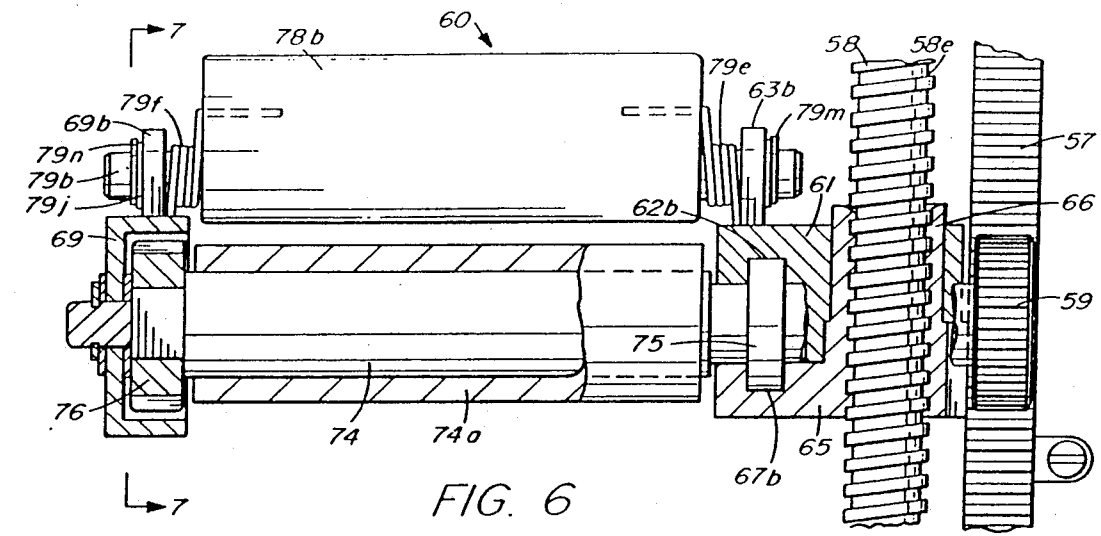
FIG. 6 is a detail view partially broken along section line 6—6 of FIG. 3.
Figure 8:
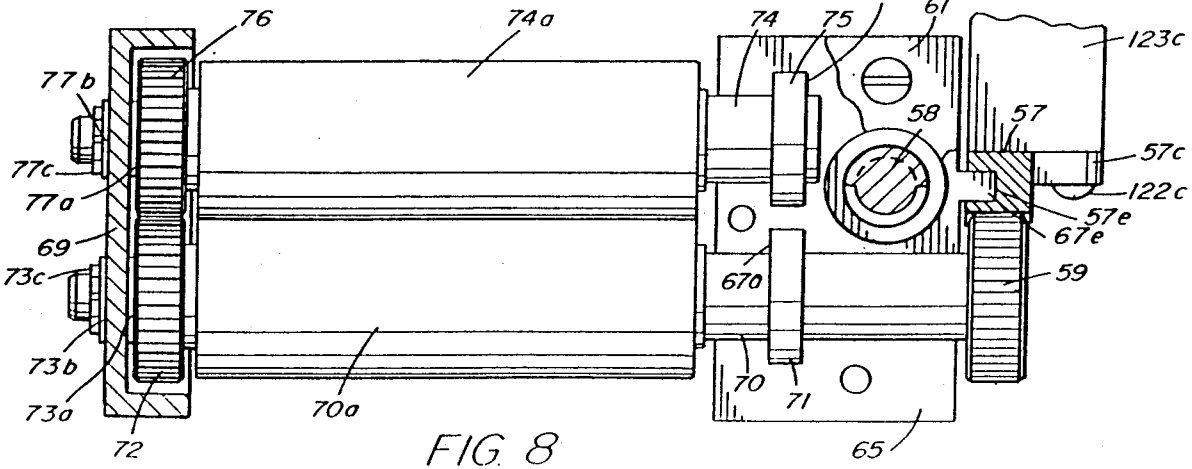
FIG. 8 is a detail view partially broken along section line 8—8 of FIG. 7.

Details of the carriage assembly 60 are shown in FIGS. 6, 7 and 8. The carriage assembly 60 generally includes an upper bracket 61, a lower bracket 65, a first roller 70, a second roller 74, a roller gear box 69, roller padding 70*a* and 74*a* and first and second guide plate 78*a* and 78*b*.

The lower bracket 65 has a vertical neck 66 having a threaded aperture for engaging the long screw 58 and has lower bearing cavities 67*a* and 67*b* for supporting and guiding both the first roller 70 and the second roller 74. A prong 67*e* on lower bracket 65 rides in guide channel 57*e* of rack 57 for stabilization of carriage assembly 60. The upper bracket 61 has a vertical bore therethrough which seats over the outer circumference of the neck 66 of the lower bracket 65, upper bearing cavities (not shown) and 62*b* for supporting and guiding both the first and the second rollers 70 and 74 and bearing walls 63*a* (FIG. 3) and 63*b* having holes for support of both the first and second guide plates 78*a* and 78*b*.

As the long screw 58 is driven, the threading in the neck 66 will ride upon the long screw threading 58*e*. The neck 66 is long enough to engage approximately twenty-six millimeters of the long screw 58 in order to stabilize the carriage assembly 60. The roller wheels 71 and 75 in both the first and second rollers 70 and 74 are supported within the bearing cavities 62*a* and 62*b* and 67*a* and 67*b* of the upper and lower brackets 61 and 65 when the brackets are attached together by screws or other suitable means of attachment. As best seen in FIG. 8, both brackets 61 and 65 include a continuous cavity 62*a* and 67*a* therethrough to accommodate first roller 70 and a partial cavity 62*b* and 67*b* to support the roller wheel 75 of the second roller 74.

A pinion 59 is attached to the first roller 70 at one end. A first roller drive gear 72 is pinned or attached by other suitable means to the other end of the first roller 70. A second roller drive gear 76 is pinned or attached by other suitable means to the other end of the second roller 74. The first roller drive gear 72 meshes with a second roller drive gear 76. Additionally, each roller 70 and 74 is coupled to its respective drive gear 72 and 76, preferably by a hex shaped bore (not shown) on each gear 72 and 76 which engages a hex shaped shaft section (not shown) on each roller 70 and 74. A roller gear box 69 is pinned over the ends of the first and second rollers 70 and 74 between two washers 73*a* and 73*b* and 77*a* and 77*b* and retained by clips 73*c* and 77*c*. The roller gear box 69 has two lower holes for support of the first and second rollers 70 and 74 and two upper bearing walls 69*a* and 69*b* having holes for support of the first and second guide plates 78*a* and 78*b*. As the long screw 58 turns, the upper and lower brackets 61 and 65 will move together in either an upward or downward direction depending upon the respective forward or reverse drive being provided by the motor 32. During this upward or downward motion of the brackets 61 and 65, contact between the rack 57 and pinion 59 will impart motion to the first roller 70. The first roller 70 drives the second roller 74.

Both rollers 70 and 74 are covered with roller padding 70*a* and 74*a* which is made of a pliable material such as rubber, foam or foam rubber. The pliable material is useful for guiding the toothpaste container 20 between the rollers 70 and 74 when the carriage assembly 60 begins at the bottom 21 of the toothpaste container 20, for obtaining a better squeeze on the toothpaste container 20 and for rolling over creases and other obstructions on toothpaste containers 20 of various sizes.

The distance between the rollers 70 and 74 and the thickness of the padding 70*a* and 74*a* creates a sufficient squeeze upon the toothpaste container 20 to remove the toothpaste while not impeding the motion of the rollers 70 and 74 and the carriage assembly 60. The open space between the rollers 70 and 74 when covered with padding 70*a* and 74*a* is preferably 0.5 millimeters and the thickness of the pads is preferably 2.5 millimeters.

Both the first guide plate 78*a* and the second plate 78*b* are attached to pins 79*a* and 79*b* which ride and are clamped within the holes on the upper bracket 61 and the roller gear box 69. Leaf springs 79*c*, 79*d*, 79*e* and 79*f* are seated at both ends of the guide plates 78*a* and 78*b* to urge the guide plates 78*a* and 78*b* to an angle of approximately 45° from a horizontal. Washers 79*g* (not shown), 79*h* (not shown), 79*i* (not shown), and 79*j* (FIG. 6) are located on pins 79*a* and 79*b* which are retained by clips 79*k*, 79*l*, 79*m* and 79*n*. However, the guide plates 78*a* and 78*b* may be rotated against the force of the leaf springs 79*c*, 79*d*, 79*e* and 79*f* to a horizontal position. The guide plates 78*a* and 78*b* help to guide the lower end 21 of the toothpaste container 20 to the open space between the first and the second rollers 70 and 74 when the carriage assembly 60 starts at the bottom 21 of the toothpaste container 20.

The guide plates 78*a* and 78*b* function to direct a toothpaste container 20 which is not installed parallel to the axial direction of the first and second rollers 70 and 74 to the open space between such rollers when the carriage assembly 60 begins at the bottom 21 of a new container of toothpaste 20. A toothpaste container 20 may be installed such that the major cross-sectional axis of the container is anywhere with a 360° range of the axial direction of the first and second rollers 70 and 74. The guide plates will force the toothpaste container to rotate so that the major cross-sectional axis will be parallel to the axial directions of rollers 70 and 74 except in one situation. This situation occurs when the bottom 21 of the toothpaste container 20 is wider than the upper ends of guide plates 78*a* and 78*b* when the guide plates 78*a* and 78*b* are forced to the horizontal position. In this situation the angular range that the toothpaste container 20 can be rotated away from the axial direction of the first and second rollers 70 and 74 and still be rotated or guided between such rollers will be decreased to an angle where the bottom 21 of the toothpaste container 20 is within the extremities of the width between the upper ends 78*c* and 78*d* of guide plates 78*a* and 78*b* when the guide plates 78*a* and 78*b* are in the horizontal position.

The guide plates 78*a* and 78*b* are also useful for guiding a slightly bent toothpaste container to the open space between the padded rollers 70 and 74 as well as guiding a toothpaste container which is partially empty before being inserted within the electric toothpaste dispenser 10. Since the guide plates 78*a* and 78*b* are allowed to rotate toward a horizontal position against the force of the leaf springs 79*c*, 79*d*, 79*e* and 79*f*, the guide plates 78*a* and 78*b* will not obstruct the approach of the carriage assembly 60 to the top of the housing 12. This allows the rollers 70 and 74 to roll to the top 23 of the toothpaste container 20 before the second switch 112 is closed thus minimizing the amount of toothpaste left within the toothpaste container 20 before the drive assembly 30 is reversed in direction.

A toggle bar 110 is seated within a toggle bar holder 111 which is attached by screws or other suitable means of attachment to the housing 12. When the carriage assembly 60 has reached the top 23 of the toothpaste container 20, the upper bracket 61 will drive the toggle bar 110 up to close the second switch S2. The second switch S2 automatically reverses the drive assembly 30 causing the carriage assembly 60 to ascend or ride back down the length of toothpaste container 20 until the prong 68 on the lower bracket 65 strikes the third switch S3 which turns the motor 30 off. At this time light 15*b* will be activated to inform a user that a new toothpaste container 20 should be installed.

Figure 9:
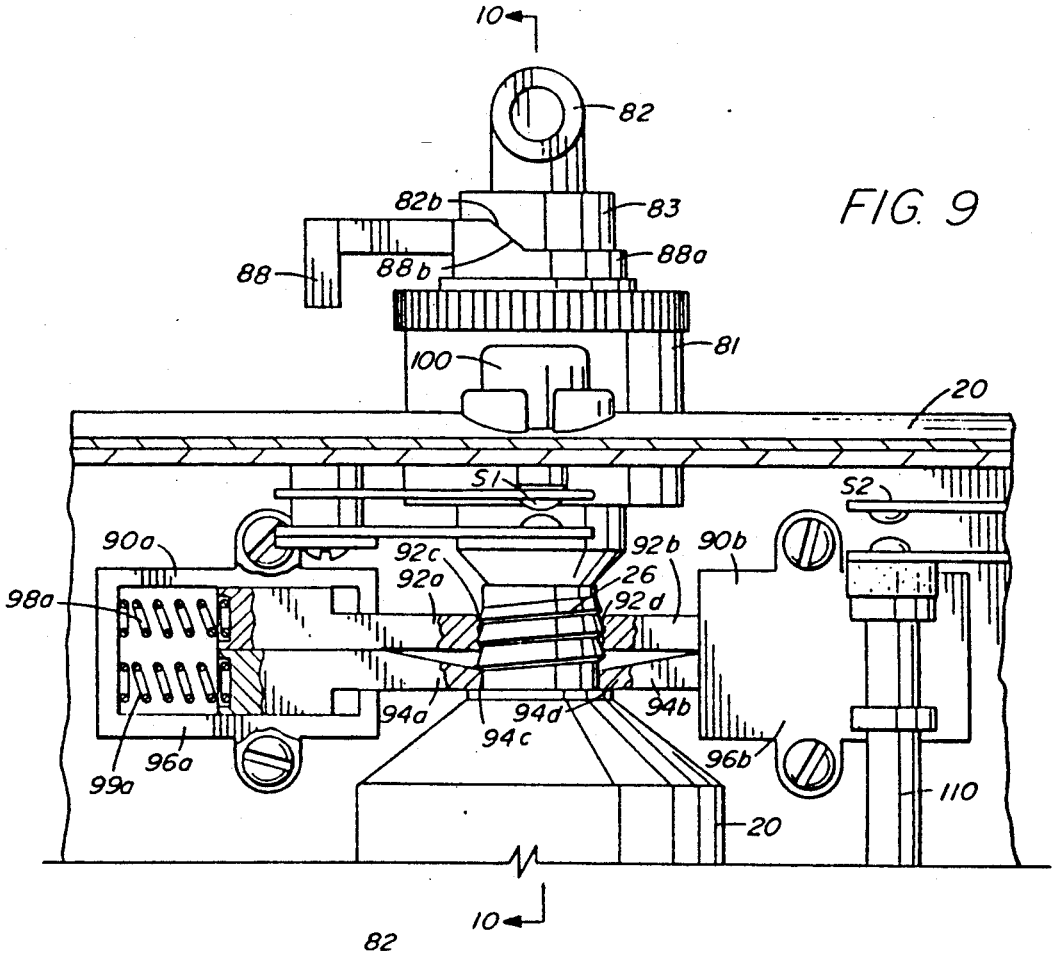
FIG. 9 is a detail view taken along section line 9—9 of FIG. 3 showing one grasping assembly in cross-section.

Referring now to FIG. 9, the details of the grasping assemblies 90*a* and 90*b* are shown. Both grasping assemblies 90*a* and 90*b* include an assembly housings 96*a* and 96*b*, respectively, which are attached by screws or other suitable means of attachment to the housing 20. Both grasping assemblies 90*a* and 90*b* include upper and lower clamps 92*a* and 92*b* and 94*a* and 94*b*, respectively. Both the upper clamps 92*a* and 92*b* and the lower clamps 94*a* and 94*b* are held together within the assembly housings 96*a* and 96*b* which restrict both vertical motion and motion in a direction perpendicular to the plane of the FIG. 9 drawing. However, the clamps 92*a* and 92*b* and 94*a* and 94*b* are allowed to move horizontally upon compression springs 98*a* and 98*b* and 99*a* and 99*b* which urge the clamps 92*a* and 92*b* and 94*a* and 94*b*, respectively, in opposing directions. Ends 92*c* and 92*d* on the upper clamps 92*a* and 92*b*, respectively, are concave to mesh with the threaded neck 26 of the toothpaste container 20. Ends 94*c* and 94*d* on the lower clamps 94*a* and 94*b*, respectively, are concave to grasp under the threads and around the neck 26 located on typical American toothpaste containers. In some situations depending upon the design of the toothpaste container 20, only either the upper or the lower clamps 92*a* and 92*b* or 94*a* and 94*b* will be needed.

The user of the electric toothpaste dispenser 10 is able to operate the grasping assemblies 90*a* and 90*b* merely by reaching within the housing and pulling the upper and lower clamps 92*a* and 92*b* and 94*a* and 94*b* apart and either removing or inserting a toothpaste container 20. Since the grasping assemblies 90*a* and 90*b* are spring loaded they will adjust or adapt to the neck size of the toothpaste container 20 installed.

Figure 10:
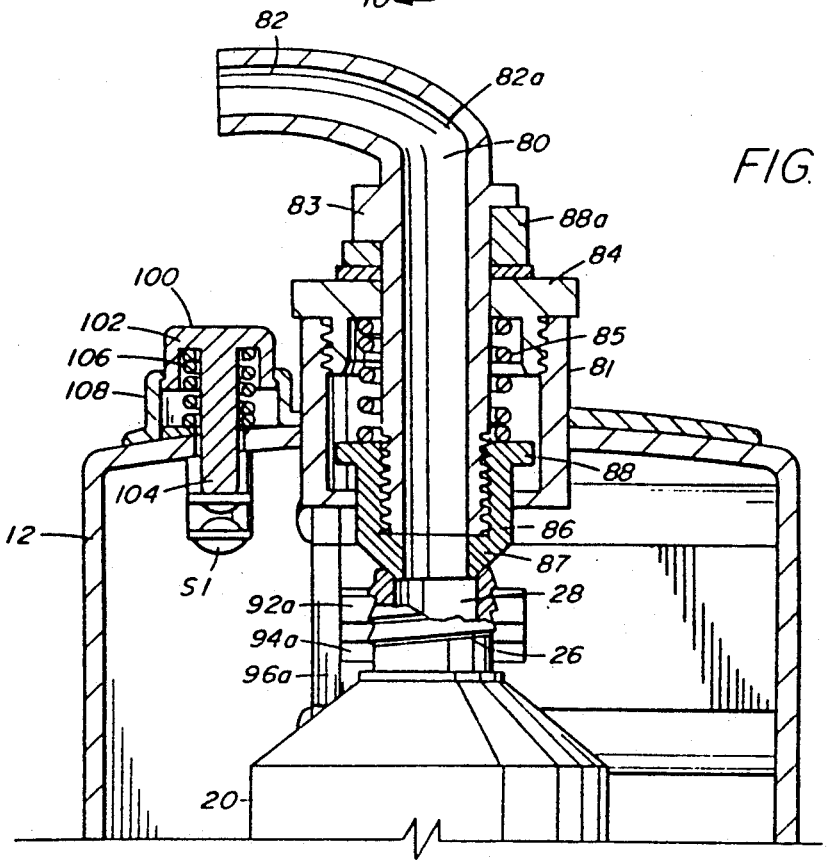
FIG. 10 is a detail view partially broken along section line 10—10 of FIG. 9.

FIGS. 9 and 10 show details of the nozzle assembly 80 and the push button 100. The push button 100 has a cap 102 and a downwardly extending prong 104. A compression spring 106 is seated over the prong 104 and compressed between the cap 102 and the housing 12 to hold the push button 100 in an upright position against a retainer 108. In this position the first switch S1 will be open. When the push button 100 is depressed the prong 104 will close the first switch S1. This will activate the motor 32 in the forward direction to drive the carriage assembly 60 up the toothpaste container 20.

The nozzle assembly 80 includes a cup cover 84, a nozzle adjustment lever 88, a spout 82, a tube fitting 86 and a spring 85. A cup 81 is threaded at its upper end for attachment of the cup cover 84 and has an opening at the lower end to allow the tube fitting 86 to pass therethrough. The cup 81 is affixed to the top of the housing 12. The spout 82 has an elbow 82*a* to deliver the toothpaste 24 to an area over or above the push button 100. A shoulder 83 is located just below the elbow 82*a*. The nozzle adjustment lever 88, cup cover 84 and spring 85 are seated over the lower end of spout 82 and held in place between shoulder 83 and tube fitting 86 which is threaded to the lower end of spout 82. The tube fitting 86 has a conical neck portion 87 for lowering, adapting or connecting to the mouth 28 of the toothpaste container 20 mounted within the housing 12. This allows for toothpaste container mouths of various sizes to be accommodated. The upper end of the tube fitting 86 includes a flange 88. This flange 88 limits the downward motion of the tube fitting 86 when the flange 88 contacts the bottom of the cup 81. Spring 85 forces the tube fitting 86 downward to maintain contact with the mouth 28 of the toothpaste container 20 while toothpaste 24 is being dispensed from the container 20.

As shown in FIG. 9, the nozzle adjustment lever 88 has a collar 88*a* which fits around the spout 82. A portion of the collar 88*a* has an inclined surface 88*b* which wedges against the inclined surface 82*b* on the spout 82. Thus by moving lever 88, the spout 82 will adjust or move in an axial direction either to lower or raise the tube fitting 86 from the mouth 24 of the toothpaste container 20.

At times toothpaste can dry within the spout 82 causing the spout 82 to be blocked. When this occurs the nozzle assembly 80 may be removed for soaking in warm water or for dislodging in some other manner. Nozzle assembly 80 is removed by unscrewing cup cover 84 from cup 81.

There are two problems which the present invention overcomes as the carriage assembly 60 ascends or descends along the toothpaste container 20. The first problem occurs when the toothpaste container 20 collapses either diagonally or toward the nozzle assembly 80. The second problem occurs when the neck 26 of the toothpaste container 20 is pulled out of the first and second grasping assemblies 90*a* and 90*b*. Both problems are affected by vibration and non-vertical forces exerted by the rollers 70 and 74. However, the first problem is primarily created by the exertion of too much vertical force in the upward direction, and the second problem is primarily created by the exertion of too much vertical force in the downward direction.

The interaction between the long screw 58, brackets 61 and 65, rack 57, pinion 59 and padded rollers 70 and 74 creates a smooth rolling motion along the toothpaste container 20 and makes the vibration and non-vertical forces negligible as compared to the rigidity of the toothpaste container 20 and the holding and stabilization abilities of the grasping assemblies 90*a* and 90*b*.

The upward and downward forces on the toothpaste container 20 are created by rollers 70 and 74 as carriage assembly 60 ascends or descends along the toothpaste container 20 and created by frictional contact between the padded rollers 70 and 74 and the toothpaste container 20. In the present invention these forces tend to balance each other out. However, the resilient mounting of the tube fitting 86 in nozzle assembly 80 will maintain contact with the mouth of the toothpaste container 20 and the holding and stabilization abilities of grasping assemblies 90*a* and 90*b* will hold the neck 26 regardless of any net force exerted by rollers 70 and 74 due to the ascending or descending motion of carriage assembly 60 and friction.

The present invention is also designed so that the rate of ascension or descension of the carriage assembly 60 and the rotational speed of rollers 70 and 74 will squeeze or compress the toothpaste container 20 to obtain a desirable flow rate of the toothpaste 24 out of the nozzle assembly 80.

The drive assembly or motor 30 operates at a speed of 5000 rotations per minute. Through the motor 32 and gear system 40 the long screw 58 is driven at 34.5 rotations per minute. The carriage assembly 60 either ascends or descends 1 millimeter per revolution of the long screw 58 depending upon the direction that motor 32 is driven. This results in the carriage assembly 60 moving at a rate of 34.5 millimeters per minute or 0.575 millimeters per second. Although other drive assemblies 30 may be devised and used, this illustrates the preferred drive speed of the carriage assembly 60 in order to obtain a desirable flow rate of toothpaste 24 out of the spout 82 and in order to hold the container 20 in place without causing container 20 to collapse or be jarred from grasping assemblies 90*a* and 90*b*.

Figure 11:
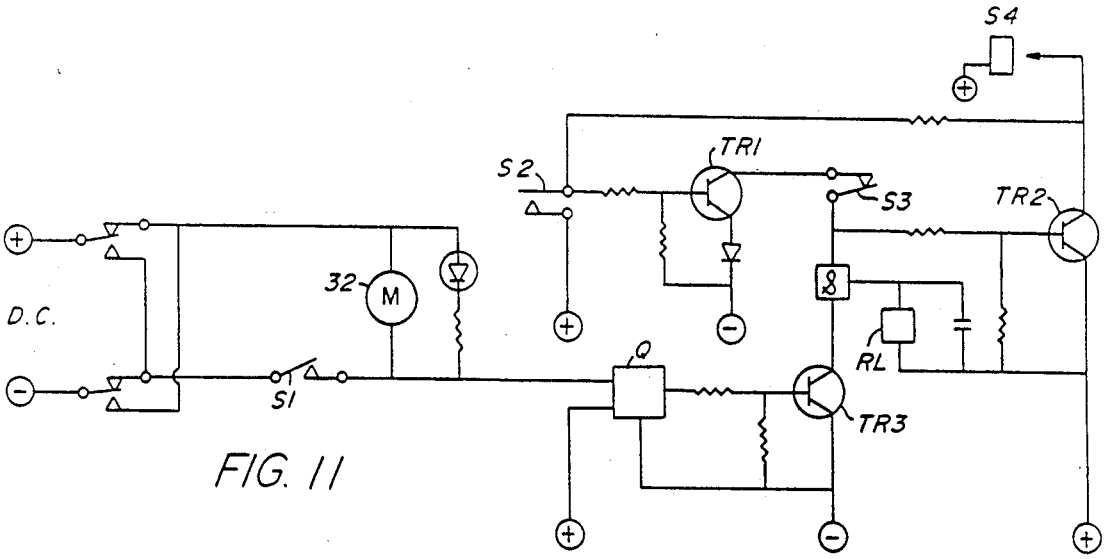
FIG. 11 is a schematic diagram of the electrical circuit employed for controlling the toothpaste dispenser of FIG. 1.

Referring to FIG. 11, circuitry for the control system of the present invention is shown. When the first switch S1 is closed the circuit is completed and the motor 32 will start running in the forward direction to squeeze toothpaste out of the toothpaste container 20. When the push button 100 is released and the first switch S1 is open, activating pulse signal generating device Q sends a signal which turns on the third transistor $TR_3$ and the third transistor $TR_3$ in turn puts the relay RL into motion. This reverses the direction of the motor 32 which causes the carriage assembly 60 to descend. The amount of time that the third transistor $TR_3$ sends the signal to the relay RL in order to reverse the motor 32 is predetermined and adjustable. It is preferred that this amount of time be set at 0.5 seconds or approximately thereabout. This automatic reversal feature which operates for a set predetermined amount of time once the push button 100 is released is designed to release any pressure on the toothpaste container 20 to prevent excess leakage of the toothpaste 24 from the nozzle assembly 80 once the push button 100 is released.

When the toggle bar 110 closes the second switch S2, the relay RL will be set into operation through the contact point of the transistor $TR_1$ and the third switch S3. In this position the motor 32 will run in the reverse direction. The transistor $TR_2$ stays in the "on" position by its self-maintaining circuit until it is restored to the original position. When the carriage assembly 60 "bottoms" the third switch S3 is opened. This turns the second transistor $TR_2$ off and the RL is restored to its normal condition. Consequently, the original state of the circuit system is recovered.

Figure 12:
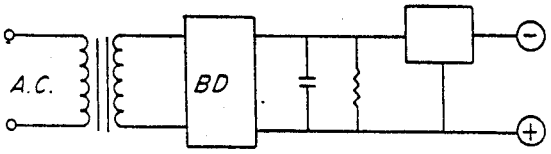
FIG. 12 is a schematic diagram of the d/c converter employed in the toothpaste dispenser of FIG. 1.

In some situations it may be desirable to reverse the direction of the motor 32 before the second switch S2 is closed. One such situation will occur when a user wishes to replace a container 20 of toothpaste or to rearrange the positioning of the toothpaste container 20. This manual reversal of the motor 32 can be achieved by reaching within the housing 12 and raising the toggle bar 110 by hand to close the second switch S2. As an option, a fourth switch S4 (shown only in FIG. 11) could be added to the exterior of the housing 12 in order to manually reverse the motor 32. FIG. 12 illustrates circuitry for the d/c converter.

Figure 13:
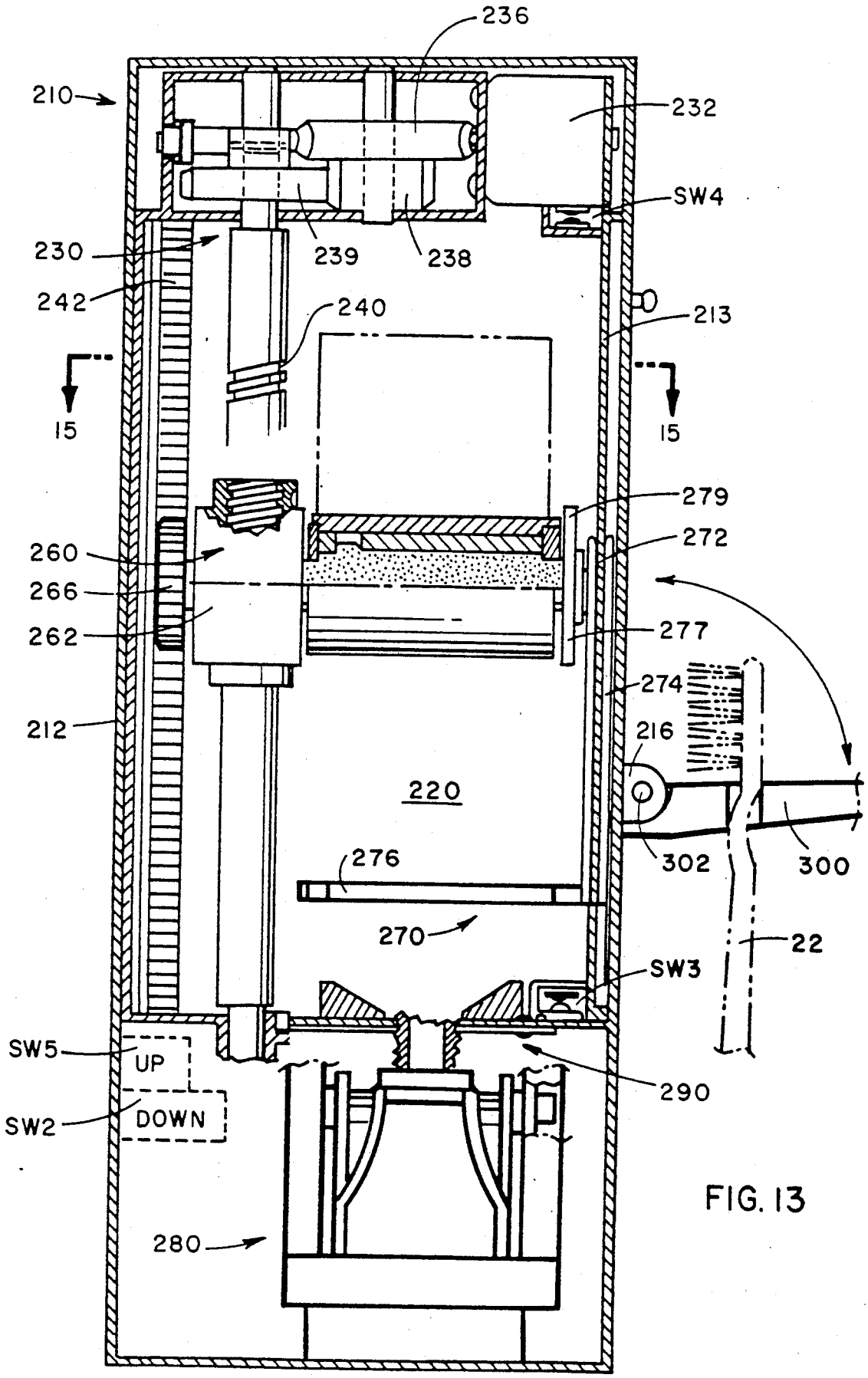
FIG. 13 is a front elevational view similar to FIG. 2 showing the interior of another embodiment of the invention.
Figure 14:
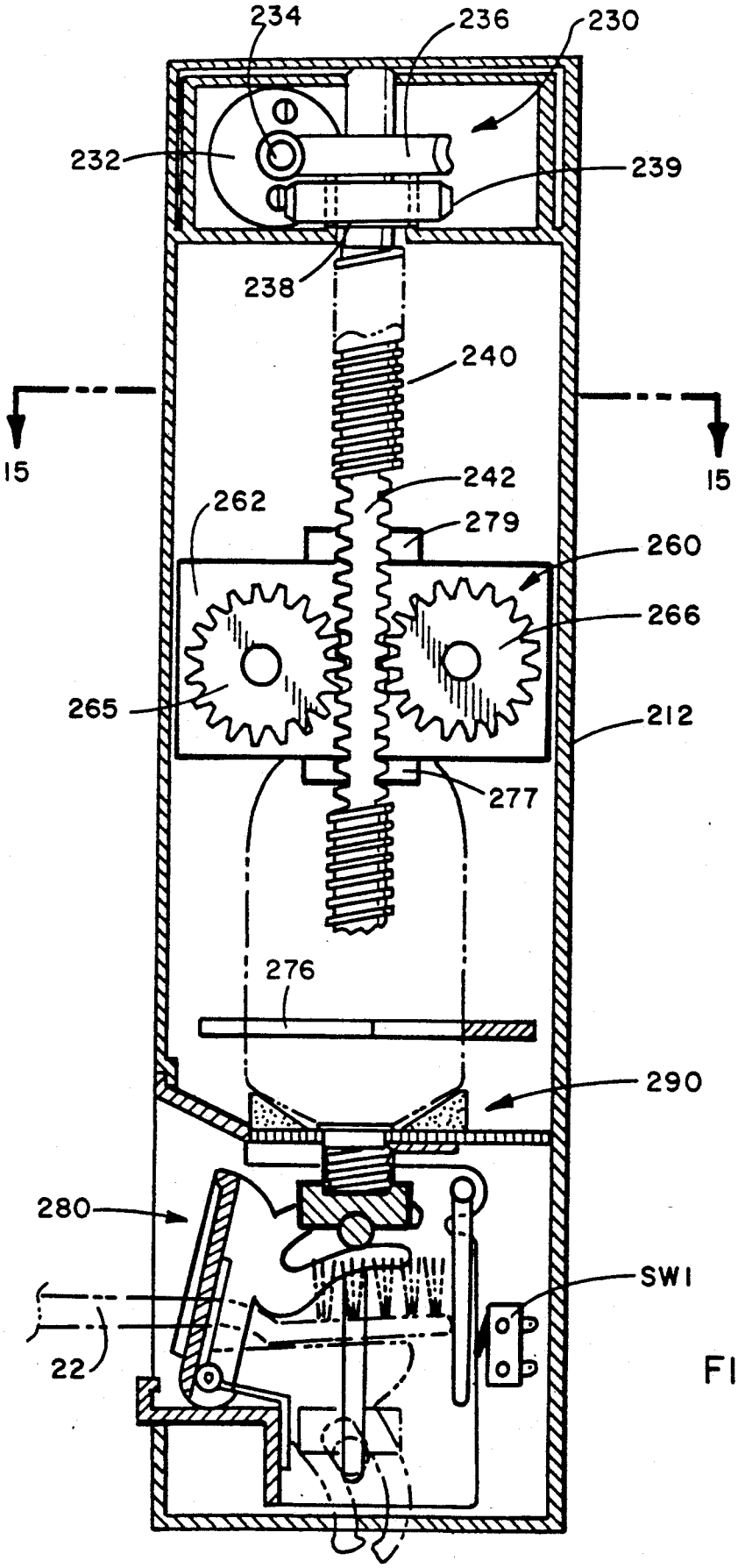
FIG. 14 is a cross-sectional side elevation view of the dispenser shown in FIG. 13.
Figure 15:
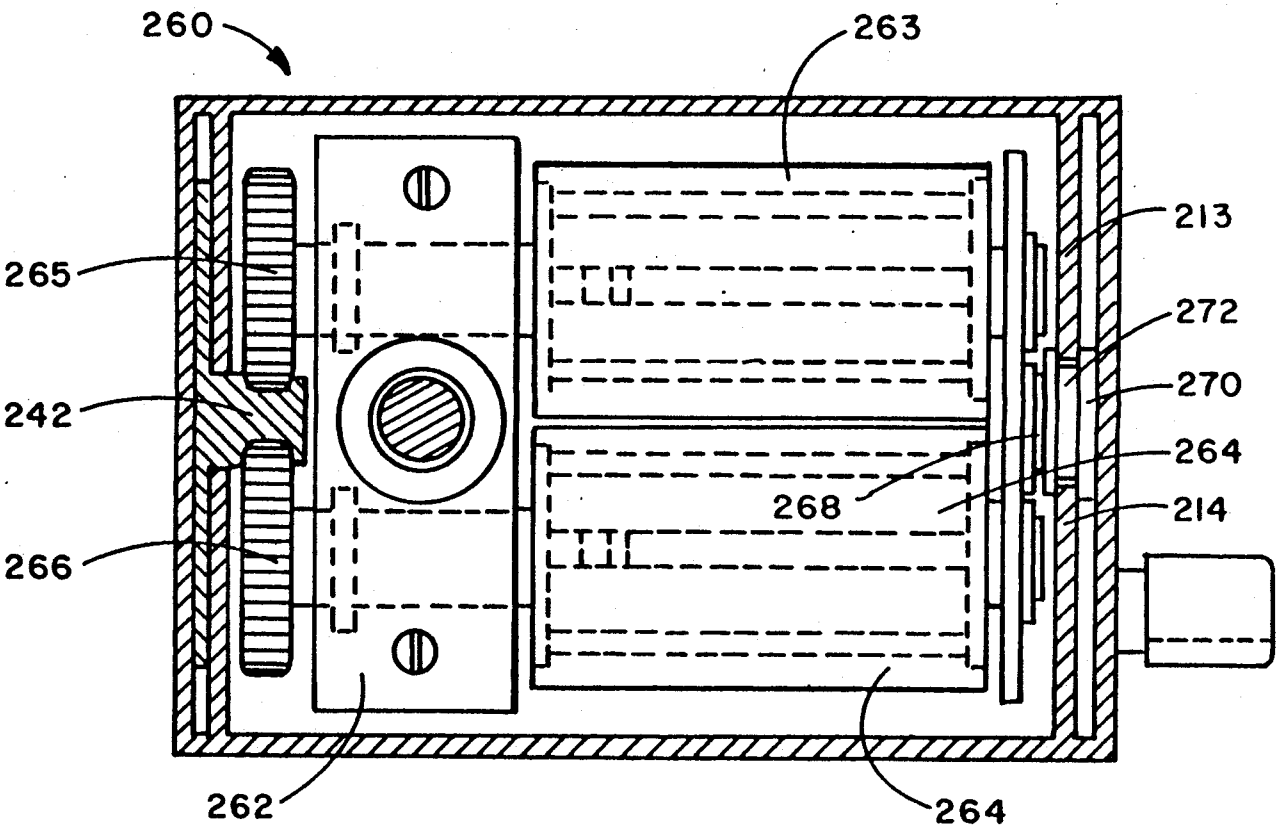
FIG. 15 is a sectional view taken along line 15—15 of FIG. 14.

Referring to FIGS. 13, 14 and 15 another embodiment of the invention with improved components is shown. This electric toothpaste dispenser 210 consists of a housing 212, a toothpaste container 220, a drive assembly 230, a carriage assembly 260, a guide and brace assembly 270, a nozzle assembly 280 and a grasping assembly 290.

In this embodiment the toothpaste container 220 is held in an inverted position. The first switch S1 is located at the bottom of the housing 212 for activating the drive assembly 230 in a forward direction. Once the carriage assembly 260 has advanced a sufficient distance along the toothpaste container 220, switch S3 will be activated by a prong 277 to reverse the direction of the drive assembly 230. Carriage assembly 260 will then retract until switch S4 is activated by a prong 279. Switch S4 will stop the drive assembly 230. Once a new toothpaste container 220 is inserted within housing 212 the drive assembly 230 can be activated at an increased speed by pressing a switch S2 until carriage assembly 260 is at the base of the toothpaste container 220 at which time S1 is used to continue the advancement of carriage 260. A switch S5 can be used to retract the carriage assembly 260 by reversing drive assembly 230. Switch S5 can be used if a user desires to change toothpaste containers 220 when the container 220 inside housing 212 is, for example, half empty.

The drive assembly 230 includes a motor 232 which is operated by a/c or d/c electricity which drives a worm gear 234 (FIG. 14). Worm gear 234 drives a worm wheel 236 and worm wheel 236 drives gear 238 which is located on the same shaft as worm wheel 236. Gear 238 drives gear 239 to rotate long screw 240. A rack 242 is fixed within housing 212 parallel and adjacent to long screw 240. The combination of the long screw 240 and rack 242 drives carriage assembly 260.

The carriage assembly 260 includes a carriage block 262 which has a vertically threaded aperture for engaging long screw 240, two squeezing rollers 263 and 264, and pinion gears 265 and 266 which are extended to the rollers 263 and 264 through the carriage block 262. Pinion gears 265 and 266 mesh with the thread of rack 242.

A guide and brace assembly 270 fits over a knob 268 which protrudes from the other end of the carriage assembly 260. The guide and brace assembly 270 helps to stabilize carriage assembly 260. The guide and brace assembly 270 includes a guide channel 272. Two walls 213 and 214 within housing 212 fit into the guide channel 272. As the carriage assembly 260 moves, walls 213 and 214 help to stabilize the carriage assembly 260 via guide and brace assembly 270. Carriage assembly 260 also includes prongs 277 and 279 for activating switches S3 and S4. Guide and brace assembly 270 includes a carrier arm 274 and a brace 276 as discussed in more detail below.

Figure 17:
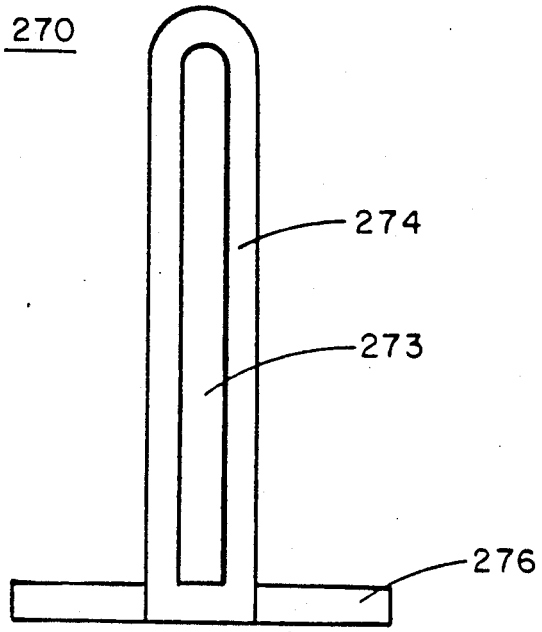
FIG. 17 is a side elevational view of the guide and brace assembly.
Figure 16:
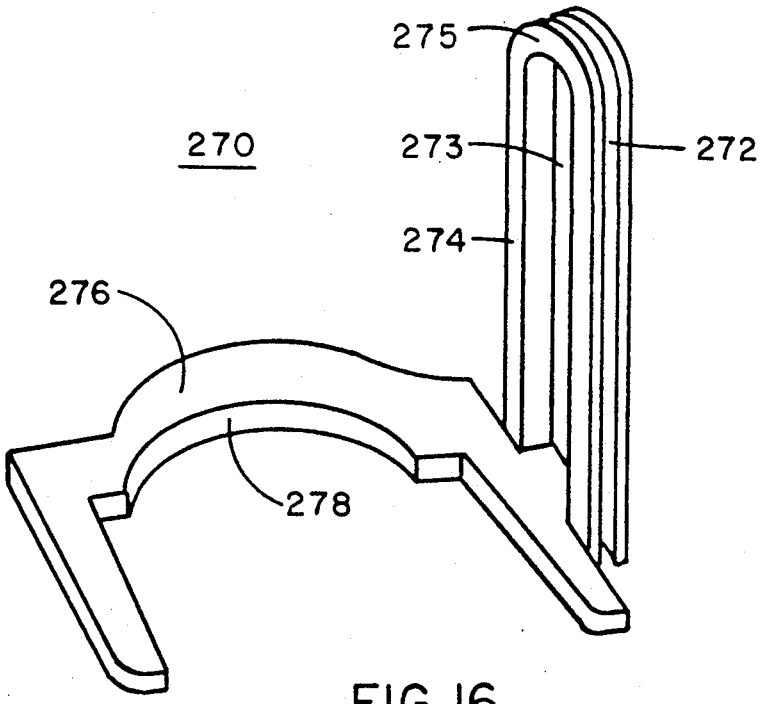
FIG. 16 is a perspective view of the guide and brace assembly of the present invention.

Referring to FIGS. 16 and 17 the guide and brace assembly 270 is shown in detail. Guide and brace assembly 270 includes carrier arm 274 and tube brace 276. Carrier arm 274 includes a guide channel 272 and a notch 273. Tube brace 276 includes a concave section 278 for conforming to toothpaste tube 220. Another arm (not shown) could protrude from tube brace 276 and ride along long screw 240 for additional support of guide and brace assembly 270.

In use, knob 268 protruding from carriage assembly 260 fits within notch 273 of carrier arm 274. Knob 268 will normally rest against the upper hooked end 275 of carrier arm 274 as carriage assembly 260 is driven up or down. When tube brace 276 reaches the bottom of housing 212 guide and brace assembly 270 will come to rest but carriage assembly 260 will continue to ride in a downward direction as knob 268 can continue to move downward within notch 273 until prong 276 strikes switch 3. Carriage assembly 260 will then move upwards and begin to carry guide and brace assembly 270 when knob 268 once again contacts hooked end 275 of carrier arm 274. Tube brace 276 helps to support tube 220 as carriage assembly 260 is driven down the tube 220.

Figure 18:
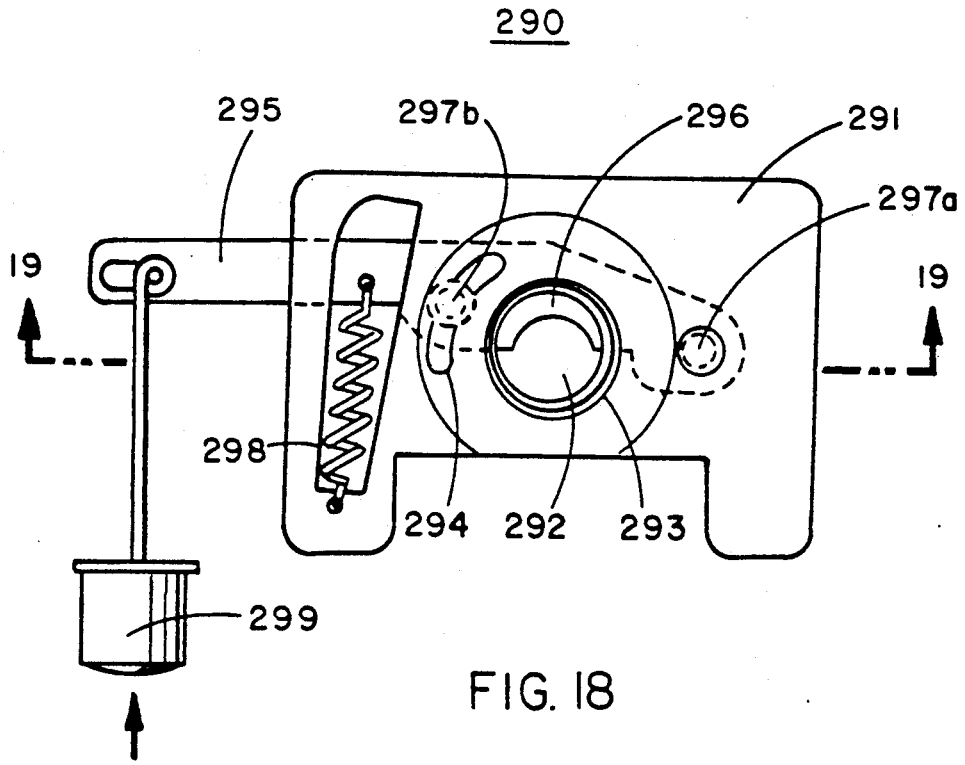
FIG. 18 is a top view of the improved grasping assembly.
Figure 19:
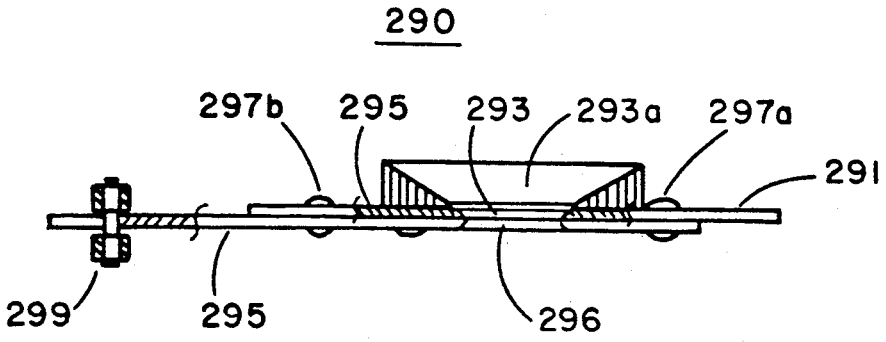
FIG. 19 is a sectional view taken along line 19—19 of FIG. 18.
Figure 22:
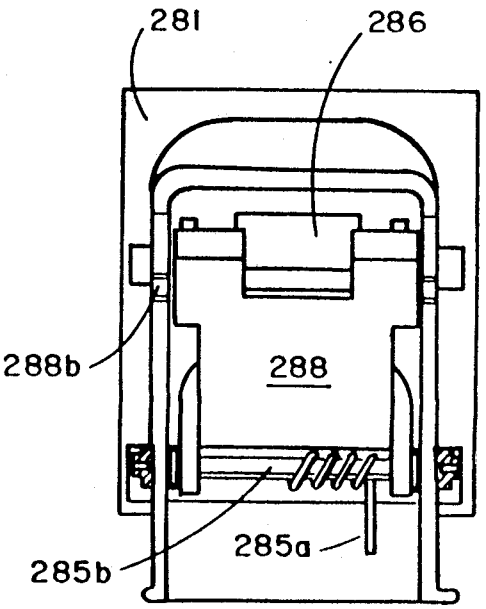
FIG. 22 is a back elevational view of the improved nozzle assembly.
Figure 20:
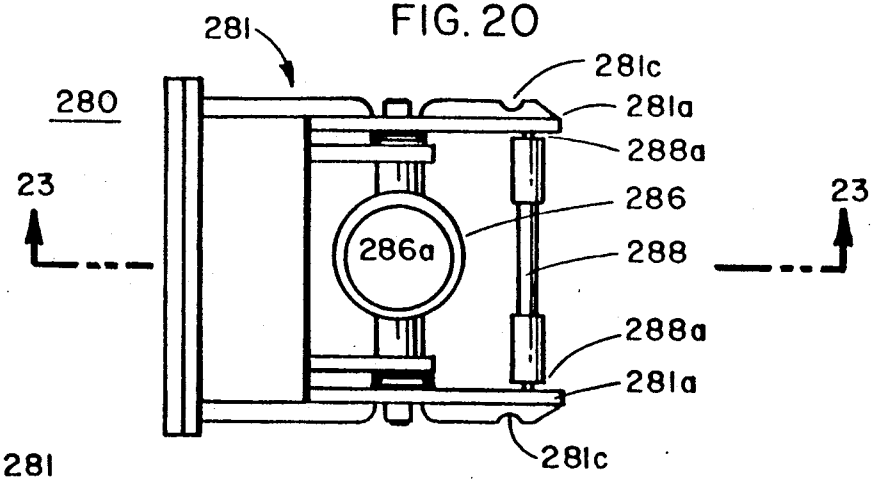
FIG. 20 is a top view of the improved nozzle assembly.
Figure 23:
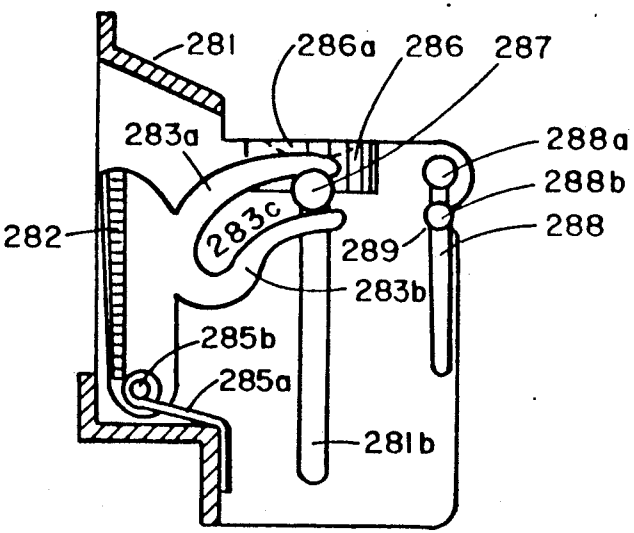
FIG. 23 is a cross-sectional view taken along line 23—23 of FIG. 20.
Figure 21:
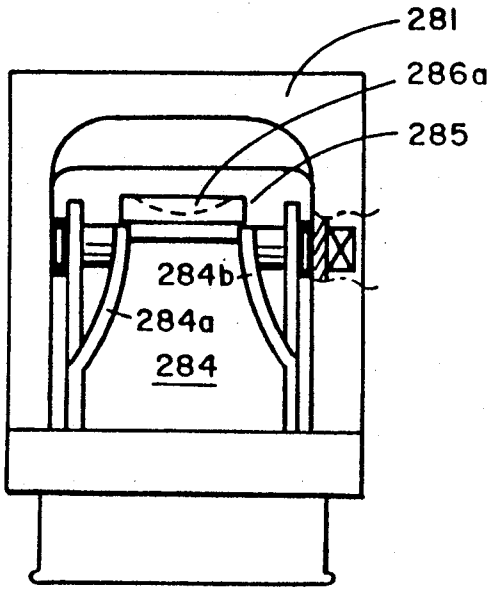
FIG. 21 is a front elevational view of the improved nozzle assembly.

Referring now to FIGS. 18 and 19 the tube grasping assembly 290 is shown. Tube grasping assembly 290 generally includes a mounting plate 291, a grasping arm 295, a spring 298 and a lever 299. Mounting plate 291 has a hole 292 therethrough for passage of the neck of the toothpaste tube 220, a grasping surface 293, a tube mounting guide **293*a* which as shown in FIG. 18 is a concave cavity and a guide groove 294. Grasping arm 295 includes a semi-circular grasping surface 296. Grasping arm 295 is pinned to mounting plate 291 with pivot pin 297*a* around which grasping arm 295 pivots within the range allowed by guidepin 297*b* and guide groove 294. Spring 298 biases semi-circular grasping surface 296 of grasping arm 295 and grasping surface 293 against the neck of the toothpaste tube 220. Tube 220 can be released by pushing lever 299 which protrudes from housing 212. The grasping assembly 290 is adaptable to the diameter and threading of the mouth of the toothpaste container and tube mounting guide 293*a* assists a user in guiding the neck of the toothpaste tube into hole 292 and helps to stabilize the container 220 during operation of the electric toothpaste dispenser 210**.

Referring to FIGS. 20–23, the nozzle assembly 280 generally includes housing 281, door 282, cap 286 and switch plate 288. Housing 281 includes side walls **281*a* which include guide grooves 281*b* and locking grooves 281*c*. Door 282 includes a chute 284 with guide walls 284*a* and 284*b*, arms 283*a* and 283*b* which define a notch 283*c*. Door 282 is resiliently mounted or urged in an upright position by spring 285*a* mounted on pin 285*b*. Cap 286 is held on pin 287 and has a concave surface or cavity 286*a*. Switch plate 288 rotates about pin 288*a* and rests in groove 289 of housing 281**.

A user will insert a toothbrush against chute 284 on door 282. The toothbrush will be guided into housing 281 by guide walls **284*a* and 284*b*. As door 282 drops open, pin 287 and cap 286 will be guided by notch 283*c* and groove 281*b* in a downward axial direction. When door 282 is completely dropped the toothbrush 22 can contact switch plate 288 which will contact switch S1. When switch S1 is contacted a predetermined volume of toothpaste will be dispensed from the container 220 while a buzzer sounds. When the buzzer completes its sound the predetermined volume of toothpaste has already been dispensed and the user can retract the brush 22. As the toothbrush 22 is retracted, spring 285*a* will urge door 282 to an upright closed position lifting pin 287 and cap 286 axially up against the mouth of the container 220. Concave surface 286*a* assists cap 286 which can rotate 5–10 degrees in either direction about pin 287 against the mouth of the container 220. Housing 281 can be removed from housing 212 by unclipping locking grooves 281*c* from knobs (not shown) within housing 212**.

Cap 286 prevents the drying and clogging of toothpaste within the mouth of the container 220 and prevents paste from dripping out of container 220. Nozzle assembly 280 allows adjustment to the length of the container neck since a container 220 with a longer neck will urge cap 286 in a downward axial direction when mounted. Nozzle assembly 280 also helps to prevent messes by axially capping container 220 rather than sliding across the mouth of the toothpaste container 220 (the capping motion is frictionless).

Figure 24:
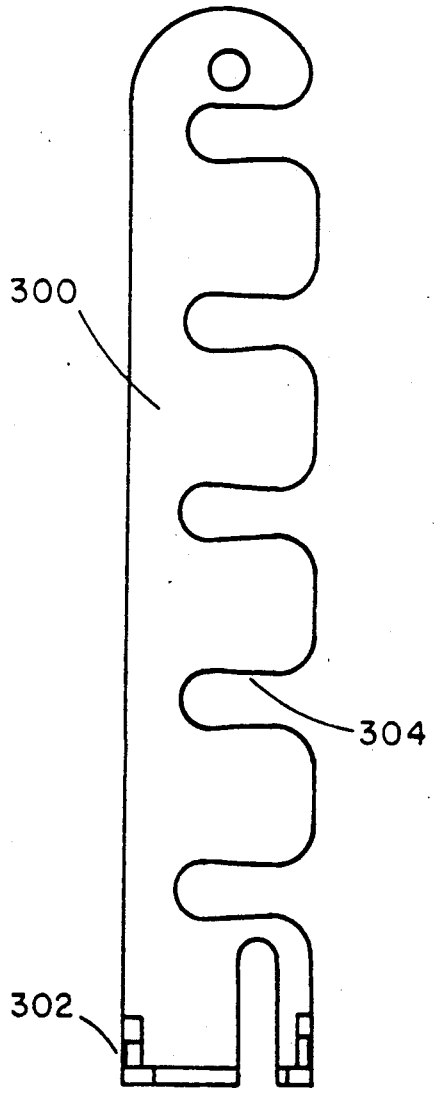
FIG. 24 is a top view of the toothbrush mounting plate.

Referring to FIG. 24 a toothbrush mounting plate 300 is shown. Toothbrush mounting plate 300 can pivot around pin 302 which is clipped into housing bearings 214. Toothbrush mounting plate 300 includes several notches 304 to be used for holding toothbrushes 22 when not in use.

Figure 25:
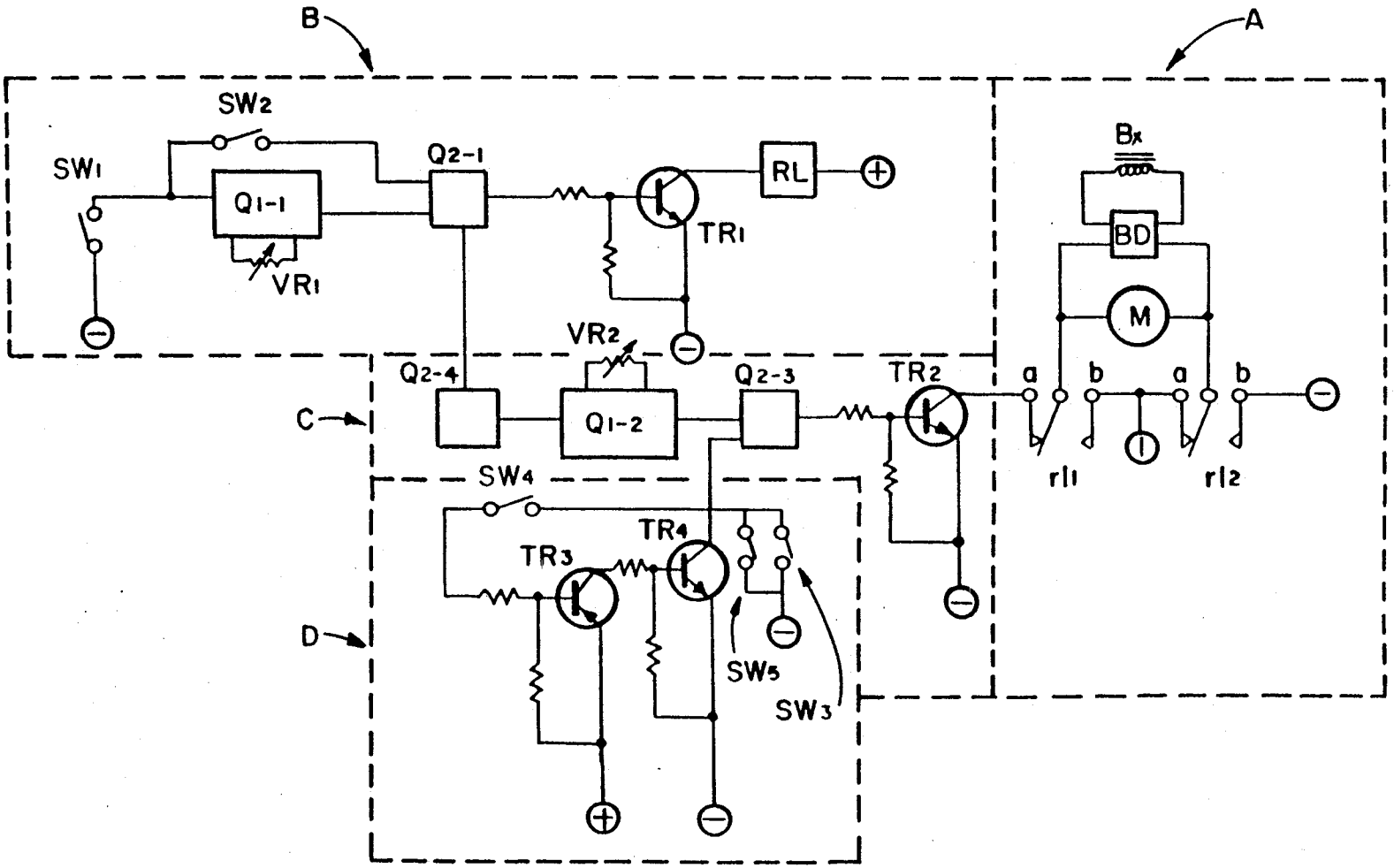
FIG. 25 is a schematic diagram of the electrical circuit employed for controlling the toothpaste dispenser of FIGS. 13-15.

FIG. 25 shows the electric circuit for the invention shown in FIGS. 13–23. When the switch S1 is activated by a toothbrush, the motor turns on and the toothpaste container is squeezed for a predetermined amount of time to dispense a predetermined volume of toothpaste set at $VR_1$. A buzzer BD sounds while the toothpaste is being dispensed or the motor is on and turns off when the dispensing is complete. The buzzer could be replaced with a light or some other signal device. A volume dispense control (not shown) may be built into housing 212 and the circuit so that a user can adjust the amount of toothpaste to be dispensed. After the volume of toothpaste has been dispensed the motor will reverse for about 0.5 seconds to take pressure off the toothpaste container. When prong 277 contacts switch S3 the motor is reversed and carriage assembly 260 will retract until prong 279 strikes switch S4 to turn the motor off. A user can then remove the old toothpaste tube 220 and mount a new tube within grasping assembly 290. Once the new tube is inserted the user can adjust the carriage assembly 260 through manipulation of switch S2 while simultaneously activating switch S1. Switch S2 is particularly useful when installing a short tube. If a user desires to change containers 220 before the container is empty switch S5 is used to retract carriage assembly 260.

The preferred embodiment of this invention has been shown and described above. It is to be understood that minor changes in the details, construction and arrangement of the parts may be made without departing from the spirit or scope of the invention as claimed.

What is claimed is:

1. A toothpaste dispensing apparatus, comprising:

a housing;

a drive assembly mounted in the housing for providing drive to the toothpaste dispensing apparatus;

a first roller driven by said drive assembly;

a second roller driven by said drive assembly and juxtapositional with respect to said first roller such that said first and said second rollers will move along a length of and squeeze a toothpaste container;

a knob supported by said first and said second rollers; a guide and brace assembly including a carrier arm attached at a lower end to a tube brace to carry said tube brace;

said carrier arm defining a notch which fits over said knob whereby said carrier arm will move with said knob as said first and said second rollers are driven until said tube brace rests on a bottom of the housing whereby said knob will move within the notch;

an adaptable grasping means for grasping the toothpaste container to hold and stabilize the toothpaste container within the housing;

a nozzle assembly including a door urged to a closed position and moveable to an open position by a spring mounted on said nozzle assembly;

said nozzle assembly defining two guide grooves and further including two arms attached to said door and a cap held on a pin, said pin being guided by the guide grooves and said arms whereby said cap is urged in an axial direction against a mouth of the toothpaste container when said door is in the closed position and axially movable away from the mouth of the toothpaste container when said door is in an open position; and a control means including a means for activating said drive assembly mounted within said nozzle assembly.

2. The toothpaste dispensing apparatus according to claim 1, wherein said adaptable grasping means comprises:

a mounting plate fixed to the housing;

a grasping arm pivotally mounted on said mounting plate including a grasping surface urged against the toothpaste container; and a means for guiding and stabilizing the toothpaste container onto said mounting plate.

3. The toothpaste dispensing apparatus according to claim 1, wherein said control means includes:

a means for dispensing a predetermined volume of toothpaste activated by said activating means and a means for automatic reversal of said drive assembly activated when said dispensing means is deactivated.

4. The toothpaste dispensing apparatus according to claim 1, wherein said nozzle assembly includes a means for removing said nozzle assembly.

5. A toothpaste dispensing apparatus, comprising:

a housing;

a drive assembly mounted in the housing for providing drive to the toothpaste dispensing apparatus;

a first roller driven by said drive assembly;

a second roller driven by said drive assembly and juxtapositional with respect to said first roller such that said first and said second rollers will move along a length of and squeeze a toothpaste container;

a knob supported by said first and said second rollers; a guide and brace assembly including a carrier arm attached at a lower end to a tube brace to carry said tube brace;

said carrier arm defining a notch which fits over said knob whereby said carrier arm will move with said knob as said first and said second rollers are driven until said tube brace rests on a bottom of the housing whereby said knob will move within the notch; and a control means located on the housing for activating said drive assembly.

6. The toothpaste dispensing apparatus according to claim 5 further including an adjustable capping means comprising:

a nozzle assembly including a door urged to a closed position and moveable to an open position by a spring mounted on said nozzle assembly; and said nozzle assembly defining two guide grooves and further including two arms attached to said door and a cap held on a pin, said pin being guided by the guide grooves and said arms whereby said cap is urged in an axial direction against a mouth of the toothpaste container when said door is in the closed position and axially moveable away from the mouth of the toothpaste container when said door is in an open position.

7. The toothpaste dispensing apparatus according to claim 6, wherein said control means includes:

a means for dispensing a predetermined volume of toothpaste activated by said control means and a means for automatic reversal of said drive assembly activated when said dispensing means is deactivated.

8. The toothpaste dispensing apparatus according to claim 6, wherein said nozzle assembly includes a means for removing said nozzle assembly.

9. The toothpaste dispensing apparatus according to claim 5, further including a grasping means including a mounting plate fixed to the housing; a grasping arm pivotally mounted on said mounting plate including a grasping surface urged against the toothpaste container; and a means for guiding and stabilizing the toothpaste container onto said mounting plate.

10. A toothpaste dispensing apparatus, comprising:

a housing;

a drive assembly mounted in the housing for providing drive to the toothpaste dispensing apparatus;

a first roller driven by said drive assembly;

a second roller driven by said drive assembly and juxtapositional with respect to said first roller such that said first and said second rollers will move along a length of and squeeze a toothpaste container;

a means for grasping the toothpaste container for mounting the toothpaste container within the housing;

a nozzle assembly including a door urged to a closed position and moveable to an open position by a spring mounted on said nozzle assembly;

said nozzle assembly defining two guide grooves and further including two arms attached to said door and a cap held on a pin, said pin being guided by the guide grooves and said arms whereby said cap is urged in an axial direction against a mouth of the toothpaste container and axially moveable away from the mouth of the toothpaste container; and a control means located on the housing for activating said drive assembly.

11. The toothpaste dispensing apparatus according to claim 10 further including:

a knob supported by said first and said second rollers;

a guide and brace assembly including a carrier arm attached at a lower end to a tube brace to carry said tube brace; and said carrier arm defining a notch which fits over said knob whereby said carrier arm will move with said knob as said first and said second rollers are driven until said tube brace rests on a bottom of the housing whereby said knob will move within the notch.

12. The toothpaste dispensing apparatus according to claim 10, wherein said control means includes:

a means for dispensing a predetermined volume of toothpaste activated by said control means and a means for automatic reversal of said drive assembly activated when said dispensing means is deactivated.

13. The toothpaste dispensing apparatus according to claim 10, wherein said nozzle assembly includes a means for removing said nozzle assembly.

14. The toothpaste dispensing apparatus according to claim 10, wherein said grasping means includes a mounting plate fixed to the housing; a grasping arm pivotally mounted on said mounting plate including a grasping surface urged against the toothpaste container; and a means for guiding and stabilizing the toothpaste container onto said mounting plate.

* * * * *